US009097251B2

(12) United States Patent
Maffeis

(10) Patent No.: US 9,097,251 B2
(45) Date of Patent: Aug. 4, 2015

(54) VARIABLE-DISPLACEMENT LUBRICANT PUMP

(75) Inventor: Jerome Maffeis, Metz (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 733 days.

(21) Appl. No.: 13/378,050

(22) PCT Filed: Jun. 16, 2010

(86) PCT No.: PCT/EP2010/058470
§ 371 (c)(1),
(2), (4) Date: Mar. 1, 2012

(87) PCT Pub. No.: WO2010/146087
PCT Pub. Date: Dec. 23, 2010

(65) Prior Publication Data

US 2012/0183426 A1 Jul. 19, 2012

(30) Foreign Application Priority Data

Jun. 16, 2009 (EP) ..... 09162829

(51) Int. Cl.
*F04C 14/24* (2006.01)
*F04C 2/344* (2006.01)
*F04C 14/22* (2006.01)

(52) U.S. Cl.
CPC ..... *F04C 2/3442* (2013.01); *F04C 14/223* (2013.01); *F04C 14/24* (2013.01); *F04C 2270/19* (2013.01); *F04C 2270/195* (2013.01)

(58) Field of Classification Search
CPC ..... F04C 14/223; F04C 14/226; F04C 28/18; F04C 28/22; F04C 2/3441; F04C 2/348; F04C 2270/18; F04C 2270/19; F04C 2270/185; F04C 2270/195
USPC ..... 417/32, 220, 310, 213, 219, 274, 292, 417/410.3
See application file for complete search history.

(56) References Cited

U.S. PATENT DOCUMENTS 2,575,100 A 11/1951 Duey
2,716,946 A * 9/1955 Hardy ..... 417/213
4,139,150 A 2/1979 Graversen et al.
(Continued)

FOREIGN PATENT DOCUMENTS

CN 1117307 A 2/1996
CN 1403711 A 3/2003
EP 1 790 855 A2 5/2007
GB 458 378 A 12/1936
(Continued)

*Primary Examiner* — Bryan Lettman
*Assistant Examiner* — Charles W Nichols
(74) *Attorney, Agent, or Firm* — Norman B. Thot

(57) ABSTRACT

A variable-displacement lubricant pump for providing a pressurized lubricant includes a rotor with at least one radially slidable vane configured to rotate in a shiftable stator ring. A first plunger is configured to push the shiftable stator ring into a high pumping volume direction. A pressure control system is configured to control a lubricant discharge pressure of the pressurized lubricant. The pressure control system comprises a first control chamber with the first plunger being configured to move in an axial direction and a side wall. A pump outlet port is connected to the first control chamber via a first pressure conduit. A movable outlet opening is disposed in the side wall of the first control chamber, is connected to a low pressure, and is configured to move with an axial projection and to be actuated by a thermostatic element. The first plunger can cover and close the movable outlet opening.

11 Claims, 3 Drawing Sheets

(56) References Cited

U.S. PATENT DOCUMENTS

| | | | | |
|---|---|---|---|---|
| 4,249,491 | A * | 2/1981 | Stein | 123/142.5 R |
| 5,800,131 | A * | 9/1998 | Lehmann et al. | 417/220 |
| 2004/0156727 | A1 | 8/2004 | Uchino | |
| 2008/0038117 | A1 | 2/2008 | Armenio et al. | |
| 2008/0069704 | A1 * | 3/2008 | Armenio et al. | 417/310 |
| 2010/0086423 | A1 | 4/2010 | Armenio et al. | |

FOREIGN PATENT DOCUMENTS

| | | | |
|---|---|---|---|
| GB | 1 575 557 | A | 9/1980 |
| JP | 55 096388 | A | 7/1980 |
| JP | 2008-25423 | A | 2/2008 |
| WO | WO 2005/026553 | A1 | 3/2005 |
| WO | WO 2005/068838 | A1 | 7/2005 |
| WO | WO 2007/015135 | A1 | 2/2007 |
| WO | WO 2008/092594 | A1 | 8/2008 |

* cited by examiner

VARIABLE-DISPLACEMENT LUBRICANT PUMP

CROSS REFERENCE TO PRIOR APPLICATIONS

This application is a U.S. National Phase application under 35 U.S.C. §371 of International Application No. PCT/EP2010/058470, filed on Jun. 16, 2010 and which claims benefit to European Patent Application No. 09162829.7, filed on Jun. 16, 2009. The International Application was published in English on Dec. 23, 2010 as WO 2010/146087 A2 under PCT Article 21(2).

FIELD

The present invention provides a variable-displacement lubricant vane pump for an internal combustion engine which comprises a rotor with radially slidable vanes rotating in a shiftable stator ring, wherein the stator ring can be pushed by a first plunger pushing the stator ring in high pumping volume direction.

BACKGROUND

WO 2005/026553 A1 describes variable displacement vane pumps with a pressure control system for controlling the discharge pressure of the lubricant. The pressure control system comprises a first control chamber wherein a first plunger is provided which is movable axially. The first control chamber is connected via a first pressure conduit with the pump outlet. The pressure control system also comprises a separate control element which is realized as a cylinder-piston-element which keeps the pressure of the pressurized lubricant provided by the pump at a more or less constant level. This is realized by opening and closing a control outlet of the control chamber, thereby allowing the stator ring to move into a low pumping volume direction or being pushed into a high pumping volume direction.

The pressure control is independent from other parameters, such as lubricant temperature or others.

SUMMARY

An aspect of the present invention is to provide a variable-displacement lubricant vane pump with a pressure control which includes the lubricant temperature as a parameter.

In an embodiment, the present invention provides a variable-displacement lubricant pump for providing a pressurized lubricant for an internal combustion engine which includes a rotor with at least one radially slidable vane. The at least one radially slidable vane is configured to rotate in a shiftable stator ring. A first plunger is configured to push the shiftable stator ring into a high pumping volume direction. A pressure control system is configured to control a lubricant discharge pressure of the pressurized lubricant. The pressure control system comprises a first control chamber with the first plunger being configured to move in an axial direction and a side wall. A pump outlet port is connected to the first control chamber via a first pressure conduit. A movable outlet opening is disposed in the side wall of the first control chamber. The movable outlet opening is connected to a low pressure and is configured to move with an axial projection. The movable outlet opening and the first plunger are arranged so that the first plunger covers and closes the movable outlet opening depending on a position of the first plunger position and a position of the moveable outlet opening. The movable outlet opening is configured to be actuated by a thermostatic element based on a temperature of the pressurized lubricant.

BRIEF DESCRIPTION OF THE DRAWINGS

The present invention is described in greater detail below on the basis of embodiments and of the drawings in which.

DETAILED DESCRIPTION

Figure 1:
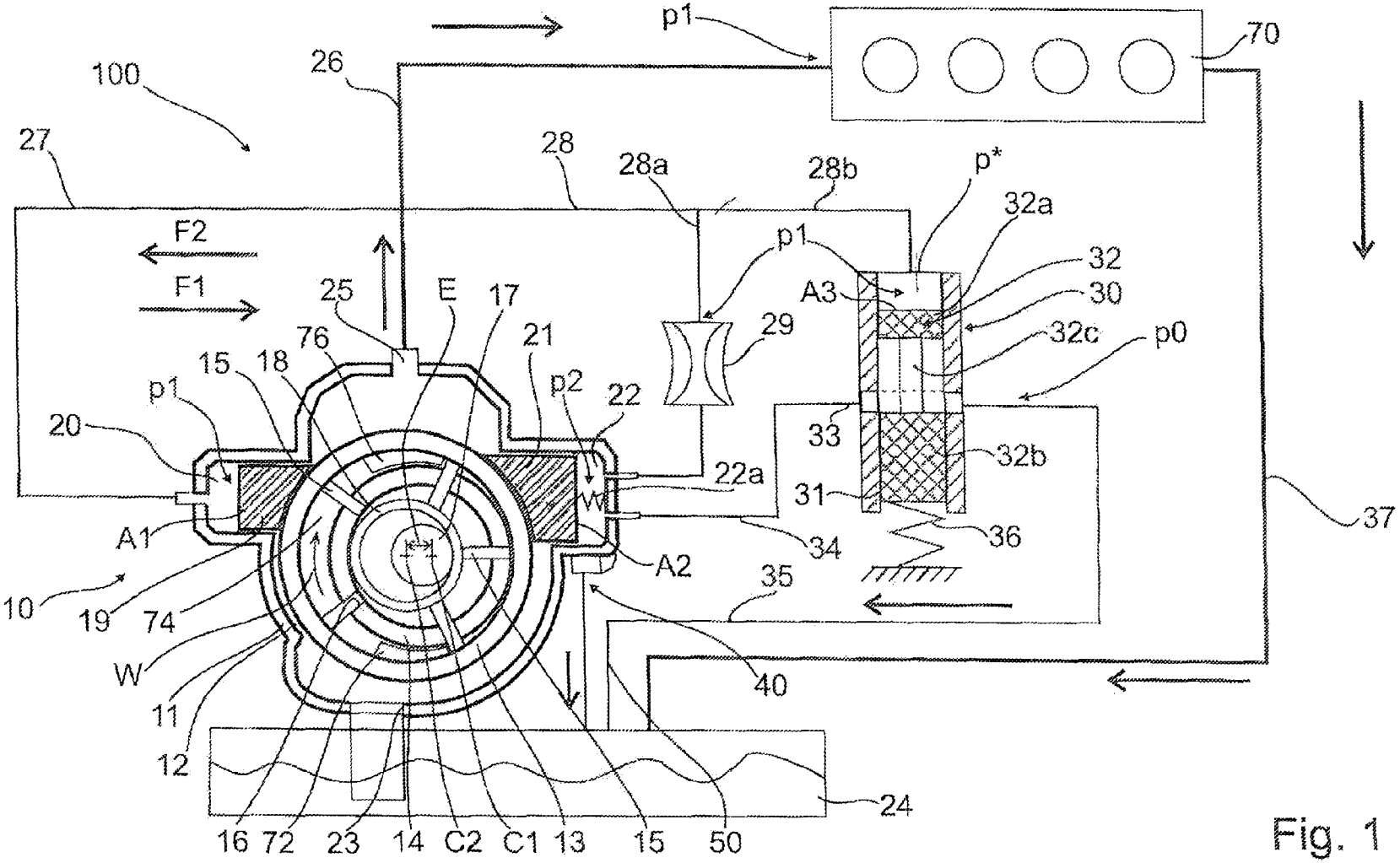
FIG. 1 shows a pumping system including a variable-delivery vane pump.

In an embodiment of the present invention, the variable-displacement lubricant vane pump can, for example, be provided with a movable outlet opening in a side wall of the first control chamber. The outlet opening can be movable in an axial projection and can be connected to a low pressure, for example, to ambient pressure. The low pressure can, for example, be lower than the pressure which is transferred by the conduit from the pump outlet port side to the first control chamber. The outlet opening can be movable in axial direction or in a direction with an axial component. The axial direction can be the movement direction of the plunger. The side wall can be a control chamber wall which guides the plunger, but is not a front wall of the control chamber. The outlet opening can be connected to a low pressure, for example, to ambient pressure, such as to atmospheric pressure, and can, for example, be connected to the lubricant tank.

The first plunger, which is connected to the shiftable stator ring and moves axially in the control chamber, can cover and thereby close the movable outlet opening. The outlet opening can be moved by a thermostatic element which is affected by the lubricant temperature. This means that the outlet opening position in the control chamber is dependent on the temperature of the lubricant.

When the lubricant temperature is low, the movable outlet opening is in a position causing a low maximum pumping volume. When the lubricant temperature is high, the movable outlet opening is in a position which causes a relatively high maximum pumping volume. This has the effect that, when the lubricant and the internal combustion engine are cold, the maximum pumping volume of the pump is limited to a relatively low value, so that the energy consumption for driving the lubricant pump is also lowered, while the discharge pressure still is high enough to guarantee a sufficient lubrication of the engine.

The maximum pumping volume is now not limited when the lubricant temperature exceeds a fixed value defined by the thermostatic element and the end position of the outlet opening.

The thermostatic element can, for example, be provided with an electrical heating element which allows the active heating of the thermostatic element so as to reduce the pumping volume limitation time.

In an embodiment of the present invention, the movable outlet opening can, for example, be provided in a movable slider as a radial bore. The slider can be movable in the same direction as the first plunger or can be movable in an angle between 0° and less than 90° with respect to the axial moving axis of the first plunger.

The slider can, for example, be provided with an axial conduit connecting the radial bore with a low pressure, for example, with the ambient pressure, such as with the atmospheric pressure inside the lubricant tank.

In an embodiment of the present invention, the slider can, for example, be pushed by a wax-element at a distal end and by a spring at the proximal end of the slider. The wax-element can push the slider towards the first plunger against the spring force when the temperature is increasing. When the temperature is decreasing, the spring force can move the slider away from the first plunger against the retracting wax-element. This configuration is technically simple, cost effective and reliable.

In an embodiment of the present invention, a second control chamber and a second plunger can, for example, be connected to the stator ring, both opposite the first control chamber and the first plunger. The second control chamber can be connected by a pressure conduit with the pump outlet.

In an embodiment of the present invention, the first plunger can, for example, be pushed into a high pumping volume position by a preload spring.

In an embodiment of the present invention, the effective surface area of the first plunger can, for example, be larger than that of the second plunger. The effective surface area of the first plunger can, for example, be between 40% and 70% larger than that of the second plunger.

In an embodiment of the present invention, a pressure throttle valve can, for example, be provided in the first pressure conduit. This throttle valve reduces the lubricant consumption of the pressure control system of the lubricant pump and is a part of the pressure control system.

In an embodiment of the present invention, another discharge conduit can, for example, be provided between the first control chamber and the ambient pressure which is not affected by the movable outlet opening and forms a second control circuit. The discharge conduit can be controlled by a pressure control valve which can, for example, be open at a high lubricant pressure and can, for example, be closed at a low lubricant pressure of the discharged lubricant. This second control circuit limits the lubricant discharge pressure to an absolute maximum pressure.

In an embodiment of the present invention, the second control circuit can, for example, act as a backup system against over pressure when the first control circuit established by the movable outlet opening is in a low pumping volume position, and serves as the only control circuit when the first control circuit is in a high pumping volume position.

In FIG. 1 shows a variable-displacement lubricant vane pump 10 as a part of a pumping system 100 for supplying an internal combustion engine 70 with a lubricant. The pump 10 comprises a main body 11 having a cavity 12 in which a shiftable stator ring 13 translates.

The stator ring 13 encircles a rotor 14 having numerous vanes 15, which can move radially in radial slits 16 formed in the ringlike rotor 14, which is rotated in the direction indicated by arrow W. The pump main body 11 is closed by two side walls of which one is not shown in the drawings. The side walls, the vanes 15, the rotor 14 and the stator ring 13 enclose a few pump chambers 74. One side wall is provided with a pump chamber inlet opening 72 and with a pump chamber outlet opening 76.

The rotor 14 surrounds a shaft 17 connected mechanically to the rotor 14 and houses a floating ring 18 surrounding the shaft 17 on which the inner ends of the vanes 15 are supported.

The shaft 17 has a fixed center C1 and the stator ring 13 has a movable center C2. The distance between the centers C1 and C2 represents the eccentricity E of the pump 10. The lubricant discharge performance of the pump 10 can be varied, as required by the engine 70 downstream from pump 10, by varying the eccentricity E.

As shown in FIG. 1, the stator ring 13 is provided with a first plunger 21 housed in part in a first control chamber 22 and with a second plunger 19 housed in part in a second control chamber 20. The plungers 19, 21 are located on opposite sides of the center C2 of the stator ring 13, and have respective front surfaces A1 and A2 facing the control chambers 20 and 22, respectively. For reasons explained in detail below, the area of surface A2 is larger than that of surface A1. More specifically, test and calculations have shown that the area of surface A2 can, for example, be 1.4 to 1.7 times larger than that of surface A1.

A preload spring 22*a* inside the first control chamber 22 exerts a relatively small pushing force on surface A2 to keep the system in a condition of maximum eccentricity E when the system 100 is idle. The control chambers 20 and 22 are formed in a main body 11 of the pump 10. The main body 11 also comprises an intake port 23 for sucking the lubricant from the lubricant tank 24 and a pump outlet port 25 for feeding lubricant to the engine 70. A conduit 26 extends from pump outlet port 25 to supply the engine 70.

As shown in FIG. 1, the lubricant, which is supplied to the engine 70, is conducted to the second control chamber 20 via a pressure conduit 27, and the lubricant is fed to the first control chamber 22 via a pressure conduit 28. More specifically, the lubricant in pressure conduit 28 is fed to the first control chamber 22 via a conduit 28*a* through a throttle valve 29, in which a calibrated pressure drop occurs as the lubricant flows through it.

The pressure conduit 28 is connected to a pressure control valve 30 by a conduit 28*b*. The pressure control valve 30 can alternatively be connected to the engine main oil gallery or to any other oil channel of the engine 70. The pressure control valve 30 comprises a cylinder 31 housing a piston 32. More specifically, as shown in FIG. 1, the piston 32 comprises a first portion 32*a* and a second portion 32*b* connected to each other by a rod 32*c*. The piston portions 32*a* and 32*b* are equal in cross section to cylinder 31, whereas the rod 32*c* is smaller in cross section than the cylinder 31.

The cylinder 31 has an inlet port 33 connected hydraulically to the first control chamber 22 by a conduit 34. The conduit 28*b* provides the discharge pressure in conduit 28 to the front surface A3 of portion 32*a* of piston 32. The dash conduit in FIG. 1 shows the situation when the control valve inlet port 33 is closed by the second piston portion 32*b*.

When the delivery pressure p1 increases along with an increase in the rotating speed of pump 10, a higher force is exerted on surface A3 and moves piston 32 against the preload force of a preload spring 36 to allow lubricant flow from conduit 34 through valve inlet port 33 and through conduit 35 into the tank 24 or, alternatively, into the pump inlet port 23. At the end of conduit 35, the lubricant is at atmospheric pressure (p0).

The piston 32 is pretensioned by the suitably dimensioned preload spring 36, which is designed to generate a force which only permits movement of piston 32 when the discharge pressure (p1) on surface A3 exceeds a given value. A return conduit 37 from the engine 70 to the tank 24 completes the pumping system 100.

When the delivery pressure (p1) reaches a value capable of generating sufficient force on surface A3 of portion 32*a* to overcome the spring force of preload spring 36, the piston 32 moves into the open configuration shown in FIG. 1, in which the rod 32*c* of piston 32 is positioned in an open position at port 33, and thereby permits the lubricant to flow from the first control chamber 22 through conduit 34 and conduit 35 into the lubricant tank 24 or, alternatively, directly to the pump inlet or any other lubricant conduit with a low pressure. When the pressure control valve 30 is open, the lubricant flows along conduit 28*a* and through the throttle valve 29, so that a lower pressure (p2) is present in the first control chamber 22 compared to the discharge pressure (p1) in the second control chamber 20.

The two different chamber pressures force the stator ring 13 to move into the direction indicated by arrow F1 to establish a balanced eccentricity E value which leads to a reduced lubricant flow to the engine 70.

If the discharge pressure (p1) exceeds a fixed pressure value (p*) determined by the characteristics of the spring 36, the piston 32 begins to move so that lubricant leaks through port 33. In other words, pressure control valve 30 also acts as a pressure dissipating device to assist in creating the desired pressure (p2) in the first control chamber 22. The pressures (p1) and (p*) are equal at the end of the transient state.

The control is continued as long as permitted by piston 32, i.e., control is taken over by the pressure control valve 30 which is determined only by the discharge pressure (p1) and is totally unaffected by undesired internal forces.

With the system 100, the discharge pressure (p1) is kept constant when the lubricant is warm, even at high rotation speed of the rotor 14. When the discharge pressure (p1) reaches a particular value (p*) which is determined by the spring 36, the stator ring 13 begins to move in the direction of arrow F1 to reduce eccentricity E and therefore to reduce the pump volume of the pump 10. The discharge pressure consequently decreases and tends to falls below a value (p*) so that the piston 32 moves into an intermediate balance position reducing the size of the control valve inlet port 33.

The pump volume remains constant at a given pressure value and, as soon as the rotation speed increases, tends to increase the pumping volume. When a given discharge pressure value (p*) is exceeded, the pressure control valve 30 opens the control valve inlet port 33, and the lubricant flows through the conduit 35 to the tank 24 so that the pressure (p2) in the first control chamber 22 is lower than (p1) and the stator ring 13 moves in the direction of arrow F1 to reduce the pumping volume, and therefore to reduce the lubricant flow rate to the combustion engine 70.

Figures 2, 4:
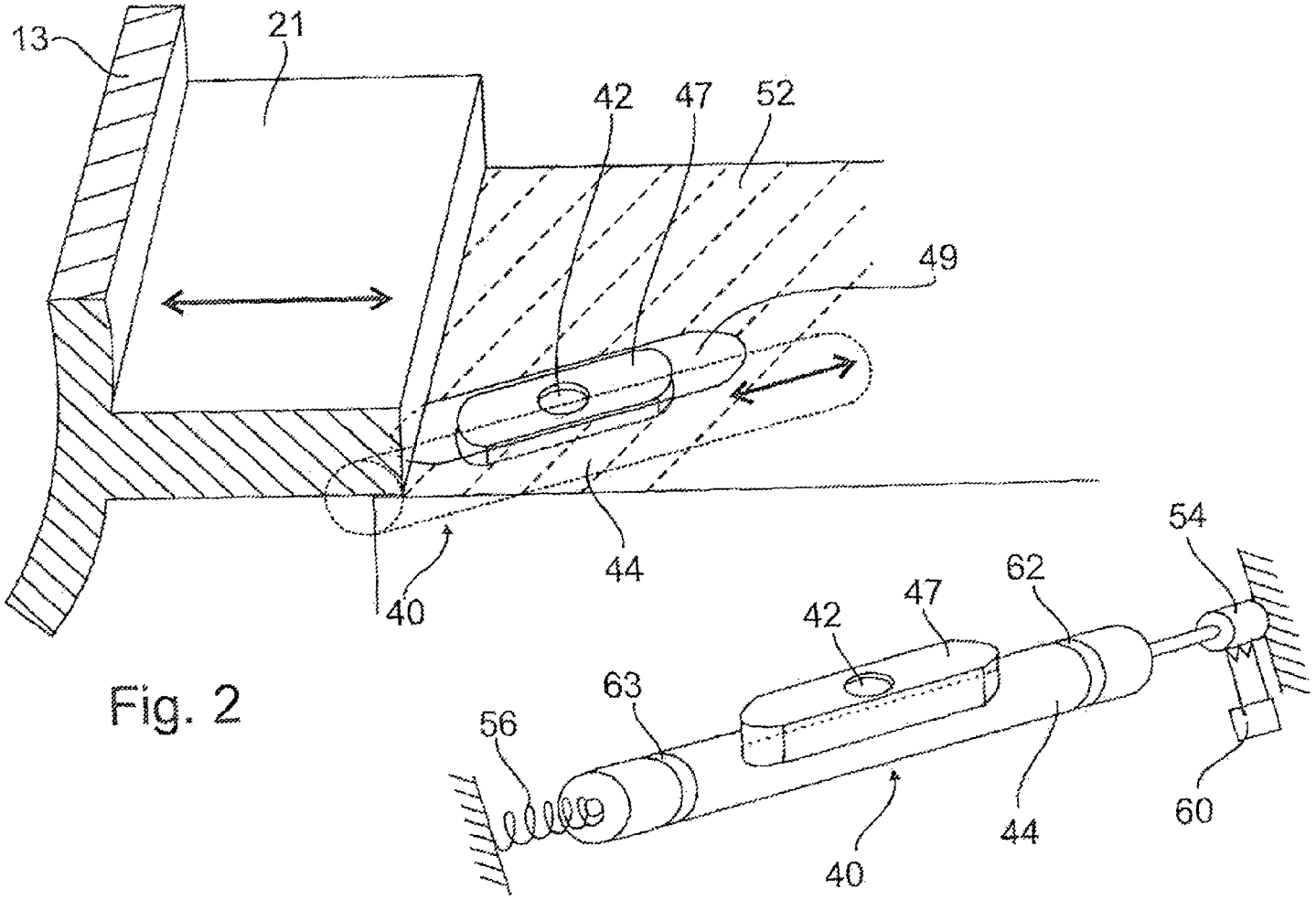
FIG. 2 shows the first control chamber including a movable slider comprising a movable outlet opening.
FIG. 4 shows the movable slider alone.
Figure 3:
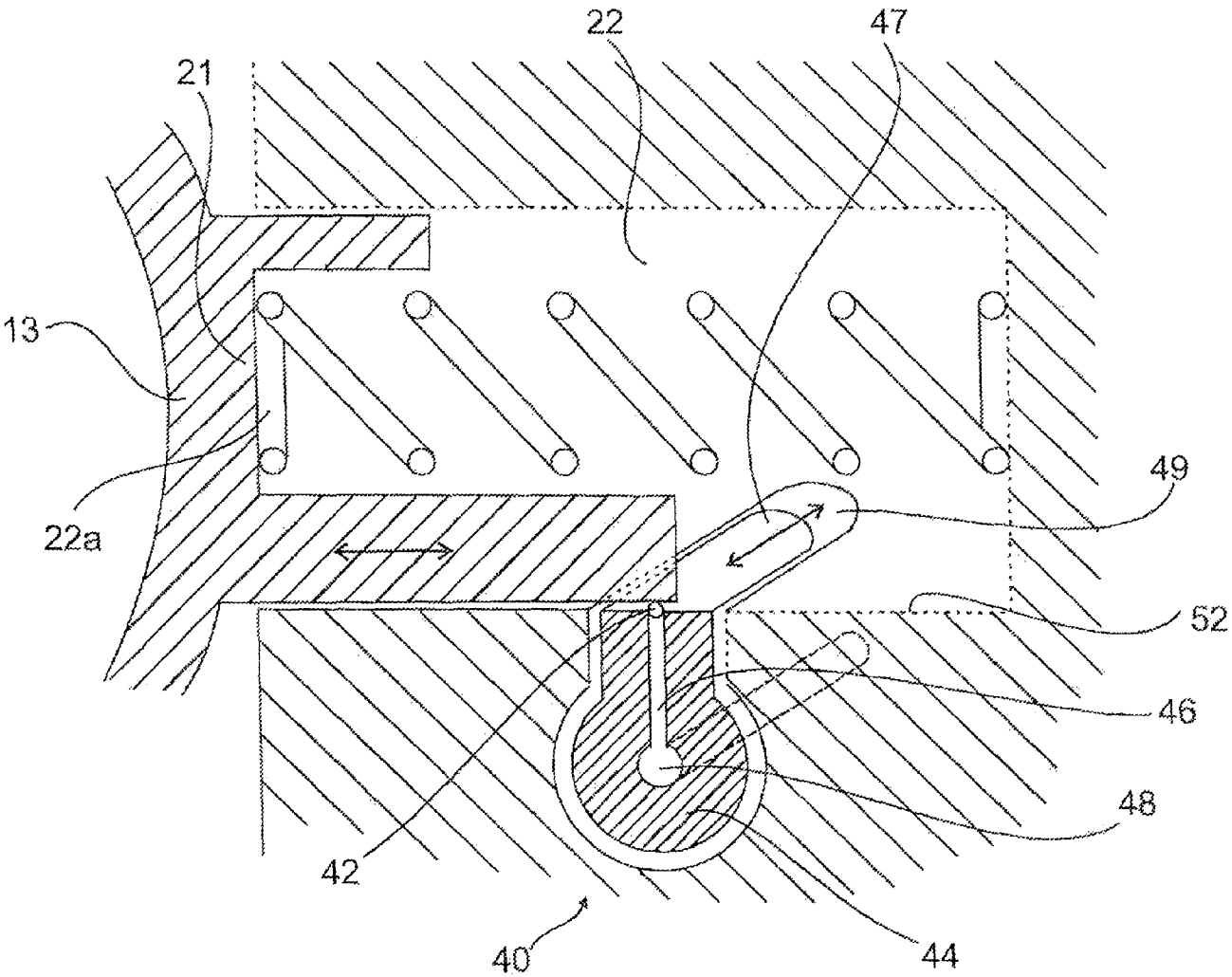
FIG. 3 shows the first control chamber of FIG. 2 in a sectional view.

As long as the lubricant is cold, and, consequently, the movable outlet opening 42 in a side wall 52 of the first control chamber 22 is not (totally) covered and thereby closed by the first plunger 21, the control of the pumping volume of the pump 10 is taken over by the thermostatic pump volume control system 40 with the movable outlet opening 42. The thermostatic pump volume control system 40, shown in FIGS. 2 and 3, limits the pump volume as long as the lubricant is cold.

The movable outlet opening 42 is the outlet opening of a movable slider 44 which is provided with a radial bore 46. The slider 44 comprises a slider head 47 moving in a longitudinal opening 49 in the chamber side wall 52. The open end of the radial bore 46 is the outlet opening 42. The radial bore 46 leads into an axial conduit 48 in the slider 44, and the axial conduit is connected to a discharge conduit 50 leading the discharged lubricant into the lubricant tank 24 or, alternatively, to the pump inlet 23 or to another port with low pressure.

The movable slider 44 is guided in an angle of approximately 5°-10° with respect to the axial moving direction of the plunger 21 so that the slider 44 and the outlet opening 42 have a moving path with an axial projection. The slider 44 is sealed with two circular sealing rings 62, 63 to reduce the lubricant loss. Depending on the position of the first plunger 21, the first plunger 21 leaves the movable outlet opening 42 totally open, keeps it totally closed by totally covering it, or covers the outlet opening 42 only in part.

The axial position of the slider 44 and of the outlet opening 42 is controlled by a thermostatic element in form of a bimetal spring or a wax-element 54 at a distal (outside) end and by a counter acting spring 56 at the proximal (inside) end of the slider 44. When the lubricant temperature and the thermostatic element temperature are low, the slider 44 and its outlet opening 42 are in a low pumping volume position at the right (distal) end. This leads to a relatively low pumping volume limitation because the stator ring 13 is forced to move to the right because of the low pressure in the first control chamber 22. In this position, the pressure control valve 30 does not affect the pressure control.

The thermostatic element 54 is provided with an electric heating element 60 which can be switched on to reduce the low pumping volume limitation time.

When the lubricant and the thermostatic element 54 become warmer, the slider 44 and its outlet opening 42 move to the left into a proximal position which causes a principally higher pumping volume and, consequently, a higher pumping discharge pressure. In the left (warm) end position, the pumping volume is not then limited by the movable outlet opening 42, so that the stator ring 13 position and the pump displacement is only controlled by the pressure control valve 30.

Pressure control valve 30 generally always limits the maximum discharge pressure, but is, in practice, only active when the movable outlet opening 42 is closed.

The thermostatic element 54 is washed by the lubricant or is in thermal connection with the lubricant so that the thermostatic element 54 has more or less the same temperature as the lubricant.

The present invention is not limited to embodiments described herein; reference should be had to the appended claims.

What is claimed is:

1. A variable-displacement lubricant pump for providing a pressurized lubricant for an internal combustion engine, the variable-displacement lubricant pump comprising:

a rotor with at least one radially slidable vane, the at least one radially slidable vane being configured to rotate in a shiftable stator ring;

a first plunger configured to push the shiftable stator ring into a high pumping volume direction;

a pressure control system configured to control a lubricant discharge pressure of the pressurized lubricant, the pressure control system comprising a first control chamber with the first plunger being configured to move in an axial direction and a side wall;

a pump outlet port connected to the first control chamber via a first pressure conduit; and a movable outlet opening disposed in the side wall of the first control chamber, the movable outlet opening being connected to a low pressure and configured to move with an axial projection;

wherein the movable outlet opening and the first plunger are arranged so that the first plunger covers and closes the movable outlet opening depending on a position of the first plunger position and a position of the moveable outlet opening, the movable outlet opening is configured to be actuated by a thermostatic element based on a temperature of the pressurized lubricant, and the movable outlet opening is disposed in a movable slider as a radial through-bore.

2. The variable-displacement lubricant pump as recited in claim 1, wherein the movable slider includes an axial conduit configured to connect the radial bore with an ambient pressure.

3. The variable-displacement lubricant pump as recited in claim 1, wherein the movable slider is provided with at least one sealing ring.

4. The variable-displacement lubricant pump as recited in claim 1, wherein the movable slider is configured to be pushed by the thermostatic element at a distal end and by a spring at a proximal end.

5. The variable-displacement lubricant pump as recited in claim 1, further comprising a second control chamber and a second plunger each disposed opposite to the first control chamber and the first plunger, and a pressure conduit, the second control chamber being connected with the pump outlet port via the pressure conduit.

6. The variable-displacement lubricant pump as recited in claim 1, wherein the first plunger is configured to be pushed by a preload spring.

7. The variable-displacement lubricant pump as recited in claim 1, wherein an effective surface area of the first plunger is larger than an effective surface area of a second plunger.

8. The variable-displacement lubricant pump as recited in claim 7, wherein the effective surface area of the first plunger is between 40% and 70% larger than the effective surface area of the second plunger.

9. The variable-displacement lubricant pump as recited in claim 1, further comprising a pressure throttle valve disposed in the first pressure conduit.

10. The variable-displacement lubricant pump as recited in claim 1, further comprising a discharge conduit disposed between the first control chamber and the low pressure, the discharge conduit being configured to be unaffected by the movable outlet opening, and a pressure control valve configured to control the discharge conduit and to open at a high delivery pressure and to close at a low delivery pressure.

11. The variable-displacement lubricant pump as recited in claim 1, further comprising an electrical heating element configured to heat the thermostatic element.

* * * * *